United States Patent [19]

Kamp

[11] 4,450,996

[45] May 29, 1984

[54] SAFETY BLADE FOR SEVERING STRETCHABLE FILM

[75] Inventor: Ewald A. Kamp, Chicago, Ill.

[73] Assignee: Union Carbide Corporation, Danbury, Conn.

[21] Appl. No.: 358,041

[22] Filed: Mar. 15, 1982

[51] Int. Cl.[3] ..... B65D 85/671

[52] U.S. Cl. ..... 225/43; 225/49; 225/91; 83/175

[58] Field of Search ..... 225/48-50, 225/91, 92; 83/175, 620

[56] References Cited

U.S. PATENT DOCUMENTS

| | | |
|---|---|---|
| Re. 25,876 | 10/1965 | Buttery et al. . |
| Re. 28,911 | 7/1976 | Jespersen et al. . |
| 293,349 | 2/1884 | Newbury . |
| 1,915,736 | 6/1977 | Hurlbut . |
| 1,917,376 | 7/1933 | Lee et al. . |
| 2,750,669 | 6/1956 | Hohmann . |
| 2,861,753 | 11/1958 | Sipior . |
| 2,920,342 | 1/1960 | Spang et al. . |
| 3,082,922 | 3/1963 | Warp . |
| 3,088,640 | 5/1963 | Kunsch . |
| 3,173,590 | 3/1965 | Bahnsen . |
| 3,547,328 | 12/1970 | Bjorklund et al. . |
| 3,552,614 | 1/1971 | Wilson et al. . |
| 3,567,087 | 2/1971 | Schramm . |
| 3,590,695 | 7/1971 | Gerard . |
| 4,064,776 | 12/1977 | Walitalo, et al. . |
| 4,283,819 | 8/1981 | Willinger . |
| 4,283,820 | 8/1981 | Willinger . |
| 4,287,648 | 9/1981 | Hineborg et al. . |

FOREIGN PATENT DOCUMENTS

| | | |
|---|---|---|
| 651689 | 10/1937 | Fed. Rep. of Germany . |
| 497951 | 12/1970 | Sweden . |
| 488543 | 7/1938 | United Kingdom . |
| 812647 | 4/1959 | United Kingdom . |

OTHER PUBLICATIONS

A Photocopy of a German Kitchen Knife Being Employed and Used in Europe.

*Primary Examiner*—Frank T. Yost

*Attorney, Agent, or Firm*—Cornelius F. O'Brien

[57] ABSTRACT

A severing blade comprising a plurality of spaced-apart extended members, each of said extended members having a blunt upper edge extremity and at least one side-extended tooth with a piercing tip disposed below the blunt upper edge extremity and in the plane of the blade so that a stretchable film transversely pulled over the severing edge will be snagged on the side-projected teeth thereby causing a segment of the film to be severed.

21 Claims, 13 Drawing Figures

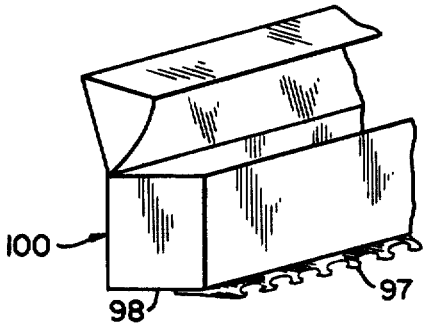
FIG. 9
FIG. 4
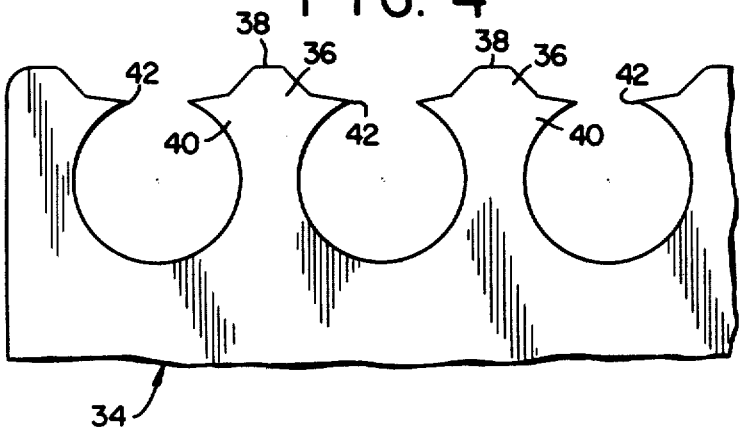
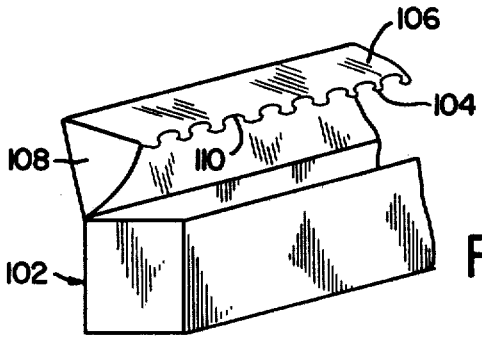
FIG. 10

FIG. 6
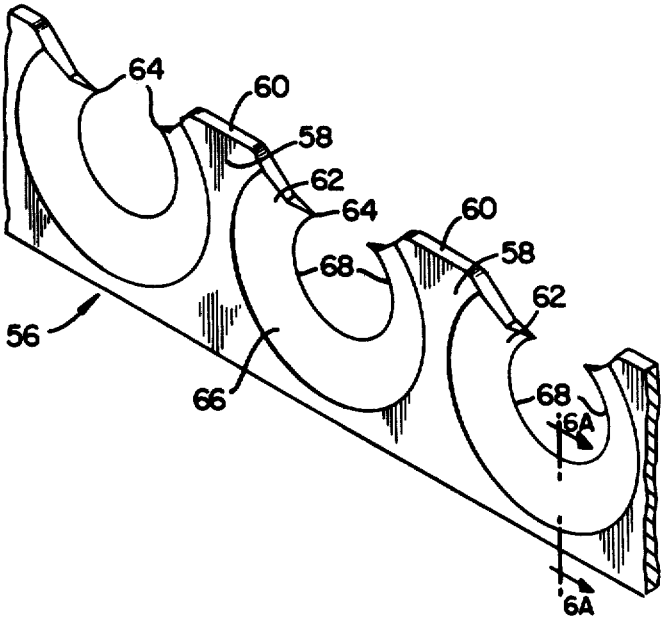
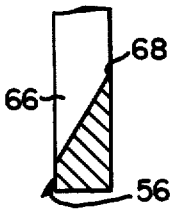
FIG. 6A
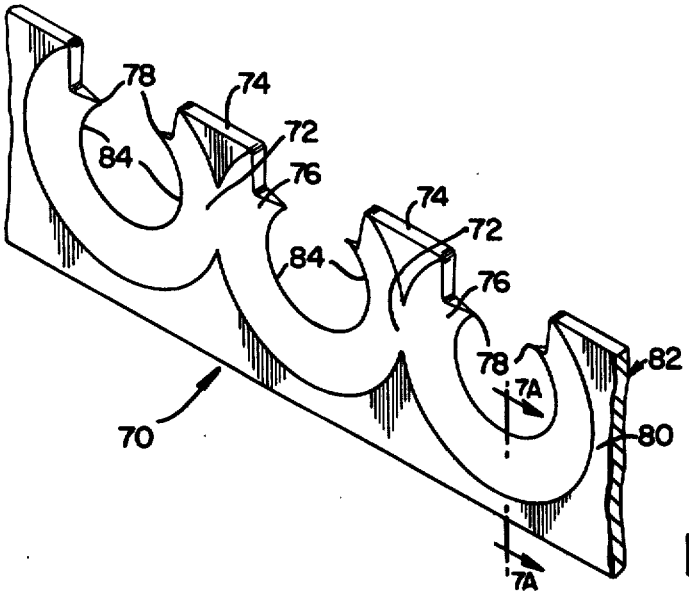
FIG. 7A
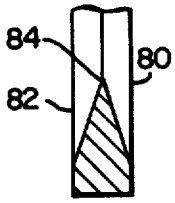
FIG. 7

FIG. 8
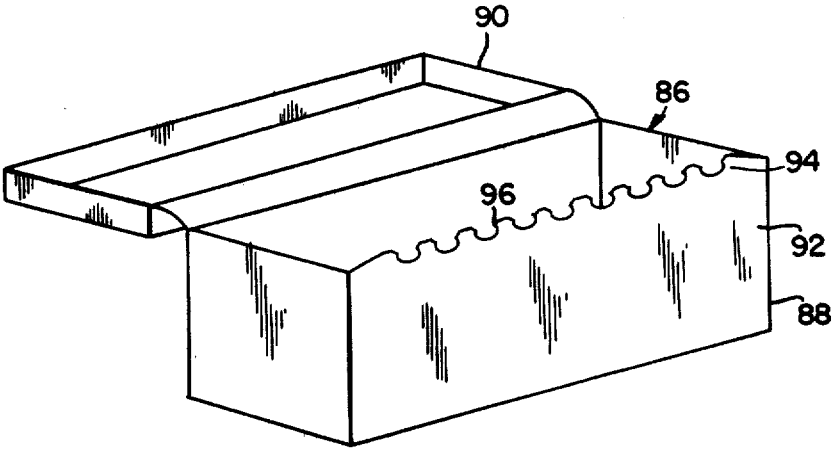
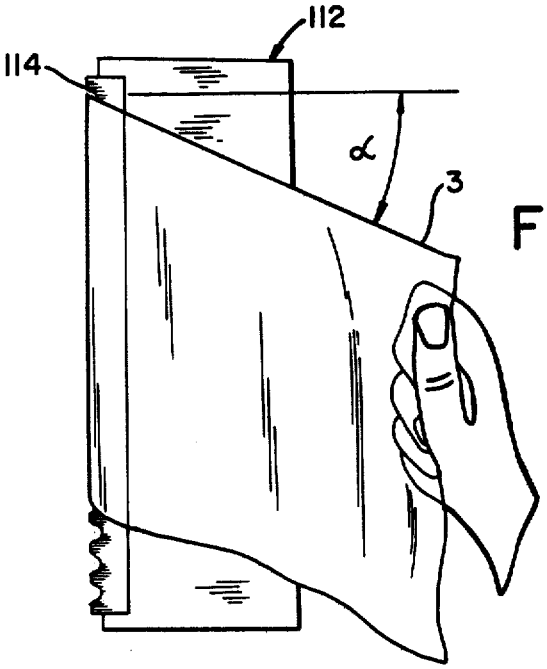
FIG. 11

SAFETY BLADE FOR SEVERING STRETCHABLE FILM

FIELD OF THE INVENTION

The invention relates to a severing blade suitable for use in severing of stretchable sheet material packaged within a rolled-sheet dispenser. Specifically, the blade comprises a plurality of spaced-apart members extending from the edge of the blade and disposed in the plane of the blade and wherein each member has a blunt upper edge extremity and at least one side extended tooth with a piercing tip disposed below the blunt upper edge extremity and in the plane of the blade so that stretchable film transversely pulled over the severing edge of the blade will be snagged by the side extended teeth thereby causing a segment of the film to be severed.

BACKGROUND OF THE INVENTION

It is known to dispense rolled-sheet material, such as waxed paper, metal foil, and the like from a rectangular container through an elongated opening. To facilitate the tearing or severing of a segment of sheet material dispensed from the container, one edge of the opening in the container usually has conventional tooth means. Generally, the tooth or severing means comprises an elongated cutter bar having a plurality of spaced-apart conventional cutting teeth. This cutting bar is secured to an edge disposed proximal the opening in the container so that segments of the sheet material dispensed through the opening can be quickly and easily severed from the roll. The low tear strength of many of these conventional sheet materials required only a slightly sharp edge.

The evolution of plastic film for consumer use as household wraps has produced various plastic films having high strength and stretch characteristics. Conventional severing means employing slightly sharp edges are unsuitable for severing these new plastic films and therefore cutter bars with sharp points or sharp side edges were contemplated. To be suitable for consumer use these devices sometimes required a guard or other safeguard means to protect a user from injury. When safeguard means are required, the cost of the cutter bars and protection means are generally relatively high when compared to the overall cost of the dispenser in which the film is packed, thus rendering them economically unsuitable for consumer use.

Of the new household wraps on the market, stretch capability and high strength for thin gauges have been found to be desirable characteristics which render the wraps ideally suited for household consumer use. Thus the desirable properties of film-type food wraps include the following:

1. "Cling"—how well the film stays wrapped around food such as sandwiches and adheres to open containers for food such as glass bowls.
2. High stretch characteristics as shown by tensile strength and elongation, puncture resistance, and Elmendorf tear.
3. Good handleability—how well the film resists tangling during use.
4. "Cutter bar tear"—how easily a length of the film may be withdrawn from a carton and severed by snagging, ripping, or cutting on the carton's cutter bar.

The cling property is typically enhanced by the use of cling additive(s) in the film. Also, the film-type food wraps are customarily produced in thin gauges such as 0.5 mil in thickness, for economy and to provide a limpness so that the film may conform to the various shapes of packaged or wrapped containers, bowls and foods. With such a thin film, toughness becomes a desirable property and manufacturers of film-type food wraps are constantly seeking to improve this property.

Consumers are also interested in the ease of dispensing and tearing off a sheet of film as it is withdrawn from the container packaging the film. For this purpose, containers such as cartons are ordinarily provided with sharp edges, usually, a saw-tooth edge, hereafter referred to as a cutter bar. Manufacturers have attempted to comply with this consumer demand by supplying film that can be withdrawn from a container to a desired length and severed along the cutter bar with ease.

With the introduction of "linear" low density polyethylene made by low pressure processes (hereinafter referred to as "LPLDPE"), attempts have been made to substitute this material for cling wrap film applications in place of conventional highly branched low density polyethylenes made by high pressure proceses (hereinafter referred to as "HPLDPE"). The reason for these efforts is that LPLDPE is widely recognized as being tougher and stronger than HPLDPE (reference: "Process Engineering News", February 1980, p. 33). However, it has been determined that typical film grade LPLDPE does not provide one of the important properties required in cling wrap plastic films, which is ease in cutter bar tear off. Even at 0.5 mil thickness, LPLDPE film is very difficult and in some instances impossible to tear off in the transverse direction of the film on conventional cutter bar strips. The film tends to elongate, and considerable effort and energy are required to sever the film. In films employing both LPLDPE and HPLDPE blends, this resistance to tear increases with the proportion of LPLDPE used.

Other tough, stretch plastic films, such as ethylene copolymers and terpolymers, and plasticized vinyls, are also difficult to tear on conventional cutter bars. It is also well known to the art that high pressure polyethylenes can be given increased stretch and toughness by blending them with other polymers such as ethylene vinyl acetate.

Suitable cling-wrap polyethylene film is disclosed in U.S. patent application Ser. No. 264,092 filed on May 15, 1981 in the name of E. N. Biel. The disclosure in this application is incorporated herein by reference. Although this disclosure recommends the use of low pressure-low density polyethylene in the range of between about 5 and about 16 weight percent of the total weight of LPLDPE plus HPLPDE, higher amounts of LPLDPE can be employed to increase the strength and stretchability of the film for use in a wide range of applications, however, such film may not be easily cut on conventional cutter bars.

U.S. patent application Ser. No. 335,615 filed on Dec. 30, 1981 by E. A. Kamp discloses a severing blade suitable for use in the severing of sheet material packaged within a rolled-sheet dispenser, said blade comprising a plurality of spaced-apart sharp piercing teeth disposed between and below a plurality of spaced-apart blunt projections so as to provide means for stretching and/or thinning a segment of a sheet material, such as film, to be severed.

It is an object of the present invention to provide a blade ideally suited for severing plastic film having high strength characteristics and high stretch capability.

Another object of the present invention is to provide a blade ideally suited for use as a severing means adapted to be used with a dispenser housing a roll of sheet material.

Another object of the present invention is to provide a blade for severing tough, stretchy, or tear resistant films, which has a built-in safety means to protect against accidental injury to the user.

Another object of the present invention is to provide a severing blade having a plurality of spaced-apart projected members each of which has at least one side extended tooth with a piercing tip so that stretchable film transversely pulled over the blade will be snagged on the side-extended teeth, thereby causing a segment of the film to be severed.

Other features and advantages of this invention will be apparent from the following description taken in conjunction with the accompanying drawings.

SUMMARY OF THE INVENTION

The invention broadly relates to a blade for use in the severing of sheet material having a severing edge comprising a plurality of spaced-apart members extending from the top edge of the blade and disposed in the plane of the blade and wherein each member has a blunt upper edge extremity and at least one side-extended tooth with a piercing tip disposed below the blunt upper edge extremity and in the plane of the blade so that the severing edge of the blade can snag sheet material on the side-extended teeth, thereby causing a segment of the material to be severed.

The blunt upper edge extremity of the extended members should be such that when the blunt edge is directed against a 0.5 mil thick plastic film containing 100% HPLDPE (having a melt index of about 2.5 and a density of about 0.927) along with a cling additive of about 0.8 weight percent glycerol monoleate, the force required to pierce the film will be at least two times greater than the force required for the piercing tip of the side-extended tooth to pierce the film. Preferably, the force required for the blunt upper edge extremity of the extended members to pierce the film should be more than four times greater than the force required by the piercing tip of the side-extended teeth to pierce the film.

The blunt upper edge extremity of the extended member performs the dual function of stretching and/or thinning a segment of the film to be severed while also providing a safety means protecting the user from accidently cutting himself, or an object, on the piercing tip of the side-extended teeth when making contact with the blade. The blunt edge should be sufficiently dull to permit securing, stretching, stressing and/or thinning of a segment of the film whereupon the sharp piercing tip of the teeth should be sufficiently tapered or peaked to snag and pierce the segment of the film to be severed. If the blunt edges are too sharp, they could cause injury to the user.

The plane of the blade of this invention could be straight line (e.g., longitudinally flat blades) or curved (e.g., arcuate blades). In addition, the severing edge of the blades could be straight, arcuate, circular, or any combination thereof.

Preferably, for the blades intended for consumer type rolled-sheet dispensers, the blunt upper edges should extent above an extended side sharp piercing tip of the tooth by at least 0.003 inch, and more preferably between about 0.005 inch and about 0.015 inch, depending on the type of film or sheet material to be severed and also upon the configuration of the severing edge of the blade. If the blunt upper edge is too high with respect to the sharp tip of the side-extended tooth, then the sharp piercing tip of the tooth will not be properly disposed to efficiently and easily snag the sheet material to be severed. On the other hand, if the blunt upper edges are too low, the sharp tip of the teeth may be exposed to cause possible injury to the user.

The blade of this invention is ideally suited to be a component of a conventional rolled-sheet dispenser adapted for packaging and dispensing of a roll of sheet material, such as stretchable wrap. The blade can be positioned at a variety of locations on a carton or dispenser so that dispensed portions of the film can be easily severed by the blade for consumer use.

The blade of this invention can be made from any rigid material such as steel, other metals, molded or stamped plastic, plastic reinforced fibers or paper base materials, and the like. The blade could be made of a metal such as steel since these materials are suitable for conventional machinery and/or stamping operations. Preferably the blades could be injection molded using plastic base materials.

The shape of the sharp piercing tip of the teeth can be of any configuration, such as triangular, pyramidal, conical and the like, as long as the extremity of each tip is sharp enough to snag and pierce a segment of film to be severed. In a like manner, the blunt edges can be of any configuration such as arcuate, curved, flat or any polygonal shape as long as the upper edge extremity is dull enough to stretch and/or thin a segment of film to be severed and not too sharp to be unsafe.

BRIEF DESCRIPTION OF THE DRAWINGS

FIG. 4 is a partial sectional side view of another embodiment of a blade of this invention having a severing edge composed of extended members, each having a blunt upper edge extremity and an extended side tooth.

FIG. 6 is a partial perspective view of a blade of this invention having a severing edge composed of extended members, each having a flat blunt upper edge and an extended side tooth with a triangular cross section.

FIG. 6A is a sectional view taken through line 6A—6A in FIG. 6.

FIG. 7 is a partial perspective view of a blade of this invention having a severing edge composed of extended members, each having a flat blunt upper edge and an extended side tooth with a triangular cross section.

FIG. 7A is a sectional view taken through line 7A—7A in FIG. 7.

FIG. 8 is a sectional perspective view of a rolled-sheet dispenser having a blade of this invention formed as a integral part of the dispenser.

FIG. 9 is a sectional perspective view of a rolled-sheet dispenser having a blade of this invention secured to one edge of the dispenser.

FIG. 10 is a sectional view of a rolled-sheet dispenser having a blade of this invention formed as an integral part of the dispenser.

FIG. 11 is a sectional bottom view of the rolled-sheet dispenser of FIG. 9 showing a segment of film dispensed from the carton and being transversely pulled across the severing blade.

Referring to FIG. 1, a blade 1 is shown having a plurality of extended spaced-apart members 2, each member 2 having a blunt upper edge extremity 4 and side-extended tooth 6 with a piercing tip 8. The blade shown has a uniform thickness so that the edge extremity 4 is relatively blunt and the piercing tip 8 is tapered to yield a sharp extremity. At the side end of blade 1, extended member 10 has only a single side-extended tooth 6 disposed inward of the blade 1 so that all the sharp tips 8 of the teeth are disposed below the blunt upper edges 4 and in the plane of the blade 1. In this arrangement, the blunt edges 4 protect a user from accidentally contacting the sharp tips 8 from the top of the blade. Blade 1 could be secured to a carton as shown in FIG. 9 whereupon a segment of stretchable film 3 assembled in the carton could be dispensed and transversely forced across the blade as generally shown in FIG. 11.

As shown in FIG. 11, a tear angle $\alpha$ of between about 25° and 55° would be suitable for most applications using the blade of this invention. Although the type of film employed and the configuration of the extended members and side teeth will determine what tear angle is optimum for easily and efficiently severing a segment of film from a roll, a tear angle $\alpha$ between about 30° and 45° would be mostly preferable by consumers. As the segment of film is transversely pulled across the blade as generally shown in FIG. 11, the extended side teeth will snag the film while the blunt edges will stretch and/or thin the film. As the force is increased, the snagged film will tear thereby severing the desired segment of film from the roll. This type of blade configuration is ideally suited for use with stretchable films of the type discussed above.

Figure 1:
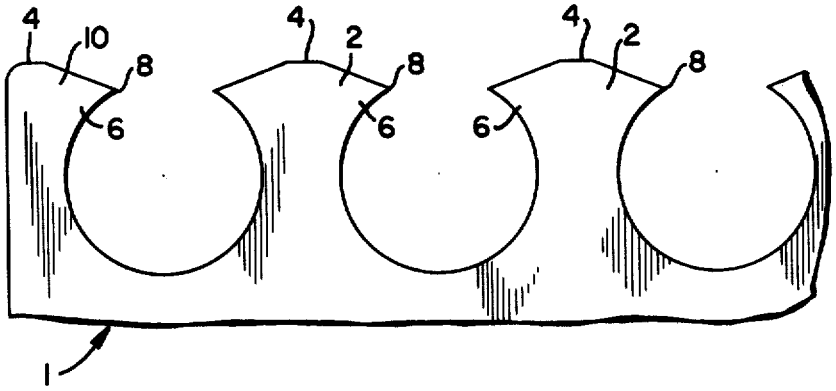
FIG. 1 is a partial sectional side view of a blade having a severing edge composed of spaced-apart extended members, each having a blunt upper edge extremity and an extended side tooth in accordance with this invention.

Blade 1 in FIG. 1 could easily be produced by simply punching circular holes in a strip of rigid material such that opposing sharp teeth 6 are formed in the upper edge of the blade. Thereafter, an inclined segment of each tooth could be removed so that the tip 8 of each tooth will be disposed below the upper edge 4 of the blade and remain in the plane of the blade. Although not shown, the blade of this invention could be fabricated by punching elliptical or any polygonal configuration in a strip of rigid material to yield extended members having side disposed teeth.

Figure 2:
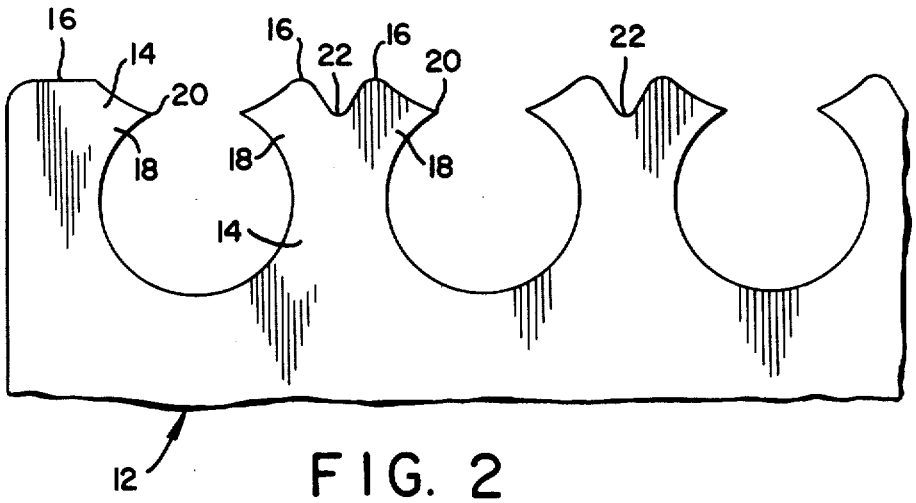
FIG. 2 is a partial sectional side view of another embodiment of a blade of this invention having a severing edge composed of extended members, each having at least one blunt upper edge extremity and an extended side tooth.

FIG. 2 shows another embodiment of a blade 12 having a plurality of extended members 14, each having a blunt upper edge extremity 16 and side-extended tooth 18 with a piercing tip 20. A notch 22 is provided at the center of extended members 14, which members have a side-extended tooth 18 on each of their sides. Notch 22 will increase the friction between the film and the severing edge of the blade over that shown in FIG. 1, said increased friction resulting in the effective stretching and thinning of the film so as to facilitate the piercing of the film by the side-extended teeth.

Figure 3:
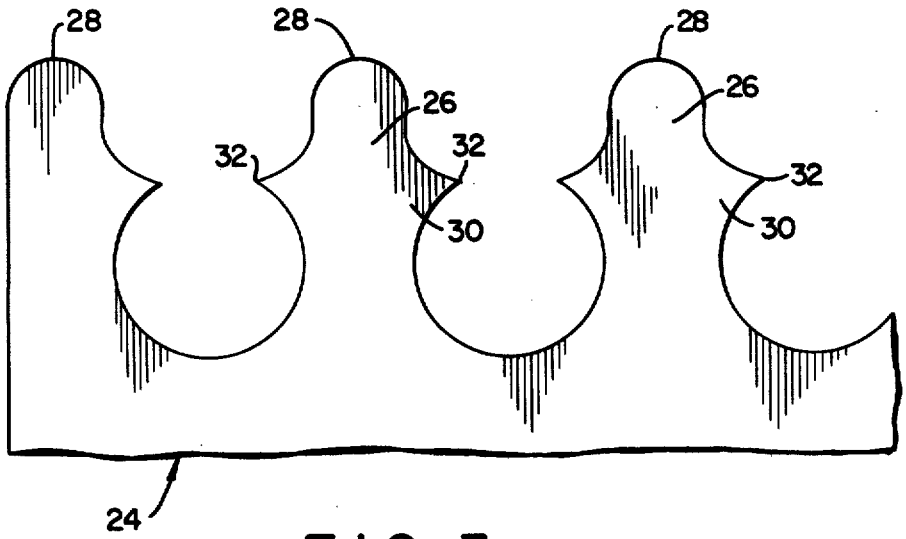
FIG. 3 is a partial sectional side view of another embodiment of a blade of this invention having a severing edge composed of extended members, each having a blunt upper edge extremity and an extended side tooth.

FIG. 3 shows another embodiment of a blade 24 having a plurality of extended members 26, each having a blunt upper edge 28 and a side-extended tooth 30 with a piercing tip 32.

FIG. 4 shows another embodiment of a blade 34 having a plurality of extended members 36, each having a blunt upper edge 38 and a side-extended tooth 40 with a sharp piercing tip 42.

Figure 5:
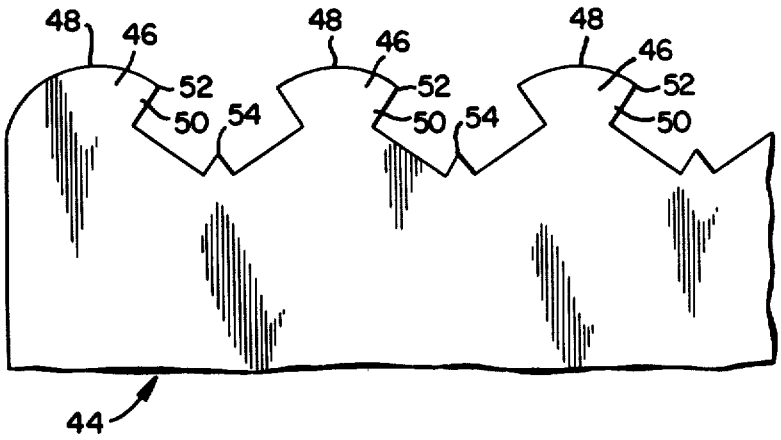
FIG. 5 is a partial sectional side view of another embodiment of a blade of this invention having a severing edge composed of extended members, each having a blunt upper edge extremity and an extended side tooth.

FIG. 5 shows another embodiment of a blade 44 having a plurality of extended members 46, each having a blunt upper edge 48 and a side-extended tooth 50 with a piercing tip 52. Disposed between two adjacent extended members 46 is a centrally located extended vertical tooth 54 which will facilitate the piercing of the film to be severed.

FIG. 6 shows a perspective view of a blade 56 having a plurality of extended members 58, each having a blunt upper edge 60 and a side-extended tooth 62 with a piercing tip 64. As shown in FIGS. 6 and 6A, one side 66 of blade 56 is beveled to generate a sharp edge 68 defining a circular arc between extended members 58. This beveled edge 68 will generate a sharper piercing tip 64 which will also function as a cutting edge.

FIG. 7 shows another perspective view of a blade 70 having a plurality of extended members 72, each having a blunt upper edge 74 and a side-extended tooth 76 with a piercing tip 78. Unlike the blade shown in FIG. 6, blade 70, as shown in FIGS. 7 and 7A, is beveled from both sides 80 and 82 of the blade to produce a sharp circular edge 84 which will function in the same manner as the circular edge 68 in blade 56 of FIGS. 6 and 6A.

FIG. 8 illustrates a rolled-sheet dispenser 86 having a container compartment 88 and cover 90. The front side wall 92 of compartment 88 has a severing edge 94 formed as an integral part of the wall and having a plurality of spaced-apart extended members 96 of the type shown in FIG. 1. The severing means could preferably be a separate blade 97 secured to the bottom wall 98 of a rolled-sheet dispenser 100 as basically shown in FIG. 9. Alternately, FIG. 10 shows a rolled-sheet dispenser 102 in which the edge 104 of the front wall 106 of cover 108 is formed into a blade configuration 110 having a severing means of the type shown in FIG. 1. Although not shown, a blade of the type shown in FIGS. 2 through 7 could be fastened to an edge of the dispenser in a conventional manner or could be formed as an integral part of the dispenser.

As shown in FIG. 11 and as discussed above, a segment of film 3 could be pulled off a roll within dispenser 112 and transversely pulled across blade 114 at a downward tear angle $\alpha$ of between about 25° and 55° depending on the type of film used and the configuration of the blade employed.

Although not shown, the blade of this invention could comprise a plurality of extended members, each having the same or a different configuration. In the preferred embodiment of the invention, the sharp tips of the side-extended teeth would be aligned and a line through the center of the tips would be substantially parallel to the longitudinal axis of the blade. A modification of the preferred embodiment would be to have more than one tooth extending from a side of the extended member and/or have the tip of the tooth inclined at an angle to the longitudinal axis of the blade. Other modifications are within the scope of this invention.

EXAMPLE 1

An Instron apparatus (Model 1130 obtained from the Instrom Corporation at 2500 Washington Street, Canton, Mass. 02021) was used to determine the force required to sever a section of different types of film when the film is forced across a cutter bar. The apparatus was used to secure the cutter bar (blade) in one Instron jaw at an angle of 30 degrees from the horizontal and then a five inch by fourteen inch section of a film was looped over the cutter bar with the ends of the film held by the other Instron jaw. The Instron crosshead was activated by causing the film to be pulled over the cutter bar until severed and the force (lbs) and energy (inch-pounds) to sever the film were measured.

Several types of stretchable cling film were produced as shown in Table 1. Each film included 0.8% glycerol monoleate as a cling additive, and the mixtures were prepared by conventional hot processing in a 25 lb. batch size Banbury-type mixer. The mixtures were then slot cast according to conventional extrusion techniques using a 2½-inch (barrel diameter) machine equipped with a 30-inch slot die.

TABLE 1

| Sample Film | LPLDPE* (Polyethylene Weight) | HPLDPE** (Polyethylene Weight) |
|---|---|---|
| ***A | — | 100% |
| B | — | 100% |
| C | 30% | 70% |
| D | 50% | 50% |
| E | 100% | — |

*LPLDPE having a melt index of 1.0 and density of 0.918
**HPLDPE having a melt index of 2.5 and density of 0.927
***Commercially available as GLAD (trademark for polyethylene film) Wrap from Union Carbide Corporation.

Each sample film was pulled over a conventional severing edge (control) of the type used on household dispensing cartons, said severing edge employing a plurality of uniformly disposed sharp teeth. In a similar manner, each sample of film was pulled over severing edges of this invention, said severing edges being as basically shown in FIGS. 1 and 2. With the severing edge held at a 30 degree angle from the horizontal, the energy required to sever each sample was calculated and is shown in Table 2.

TABLE 2

| Film Sample | Control Cutter Bar Energy (in.-lbs.) | Cutter Bar of FIG. 1 Energy (in.-lbs.) | Cutter Bar of FIG. 2 Energy (in.-lbs.) |
|---|---|---|---|
| A | 4.4 | 3.5 | 1.7 |
| B | 1.2 | 2.8 | 1.4 |
| C | 1.7 | 4.6 | 1.9 |
| D | NT* | 5.4 | 2.6 |
| E | NT* | 8.8 | 6.0 |

*Did not tear at load of 10 pounds.

EXAMPLE 2

Several types of stretchable cling film were produced as shown in Table 3. Each film included 0.8% glycerol monoleate as a cling additive, and the mixtures were prepared by conventional hot processing in a 25 lb. batch size Banbury-type mixer. The mixtures were then slot cast according to conventional extrusion techniques using a 2½-inch (barrel diameter) machine equipped with a 30-inch slot die.

TABLE 3

| Sample Film | Polyethylene Weight LPLDPE | HPLDPE |
|---|---|---|
| F | 30% | 70% |
| G | 50% | 50% |
| H | 75% | 25% |
| I | 100% | — |

The testing technique as in Example 1 was employed to test the film samples except that a rectangular wooden block having a cutter bar attached to its bottom to simulate a commercial dispenser of the type shown in FIG. 9 was employed. One end of a five by fourteen inch sample film was secured to one wall of the block using double sided adhesive tape while the other end of the film was held by the Instron jaw. The simulated dispenser was rotated about its longitudinal axis so that the segment of the film to be severed by the blade made an angle of about 30° with the wall of the simulated dispenser. With this arrangement, the segment of the film to be severed made contact only with the exposed edge of the blade that was secured to the bottom of the simulated dispenser. The simulated dispenser was then tilted such that its longitudinal axis made an angle of 30° with the horizontal. This arrangement enabled the film to be transversely pulled across the cutter bar using this apparatus.

Each sample film was then pulled over a conventional severing edge (control) of the type used on household dispensing cartons, said severing edge employing a plurality of uniformly disposed sharp teeth. In a similar manner, each sample of film was pulled over severing edges of this invention, said severing edges being as basically shown in FIGS. 1 and 4. With each severing edge arranged and positioned as described above, the peak load, average load and the energy required to sever each sample were measured and are shown in Table 4.

TABLE 4

| Film Sample | F | G | H | I |
|---|---|---|---|---|
| Control Cutter Bar | | | | |
| peak load (lbs.) | 5.5 | *NT | Not Performed | Not Performed |
| average load (lbs.) | — | NT | Not Performed | Not Performed |
| energy (in.-lbs.) | 2.5 | NT | Not Performed | Not Performed |
| Cutter Bar of FIG. 1 | | | | |
| peak load (lbs.) | 1.4 | 1.8 | 4.0 | 2.6 |
| average load (lbs.) | 0.9 | 1.1 | 2.1 | 2.0 |
| energy (in.-lbs.) | 3.6 | 4.9 | 9.8 | 11.0 |
| **Cutter Bar of FIG. 1 | | | | |
| peak load (lbs.) | 1.6 | 2.3 | 3.9 | 3.9 |
| average load (lbs.) | 1.1 | 1.8 | 2.2 | 2.4 |
| energy (in.-lbs.) | 5.2 | 9.7 | 13 | 17 |
| Cutter Bar of FIG. 4 | | | | |
| peak load (lbs.) | 1.7 | 1.9 | 4.6 | 3.6 |
| average load (lbs.) | 1.2 | 1.5 | 2.7 | 2.4 |
| energy load (in.-lbs.) | 5.9 | 7.7 | 7.7 | 13 |

*NT = Did not tear at load of 10 pounds.
**Blade was fabricated using conventional punch dies while the other blades used in the test were machined.

Using the control cutter bar in the testing of the F sample film, the film stretched 4.6 inches and then abruptly severed. Since the film did not progressively tear, the average load could not be calculated. In the testing of the G sample film using the control cutter bar, the film did not tear at a load of 10 pounds. Consequently, the H and I sample films were not tested since the G sample film, which had a lower amount of LPLDPE, did not tear when tested on the control cutter bar.

As evidence from the data presented, the blades of this invention can easily, safely and efficiently sever tough, stretchy, tear resistant film.

I claim:

1. A blade for use in the severing of sheet material having a severing edge comprising a plurality of spaced-apart members, each member extended from the upper edge of the blade and disposed in the plane of the blade, and each member having a blunt upper edge extremity and at least one side-extended tooth with a piercing tip disposed below the blunt upper edge extremity and in the plane of the blade so that the severing edge of the blade can snag sheet material on the side teeth, thereby causing a segment of the material to be severed.

2. The blade of claim 1 wherein a majority of the spaced-apart members have at least one tooth extending from each of its sides.

3. The blade of claim 1 wherein the blunt upper edge extremity extends above the tip of the side extended tooth by at least about 0.003 inch.

4. The blade of claim 1 wherein the blunt upper edge extremity extends above the tip of the side extended tooth by between about 0.005 and about 0.015 inch.

5. The blade of claim 1 wherein the extended members are uniformly distributed along the edge of the blade.

6. The blade of claim 1 wherein two adjacent extended members define an arcuate configuration between said members.

7. The blade of claim 6 wherein the arcuate configuration has a beveled edge.

8. The blade of claim 1 made of a material selected from the group consisting of metals, plastics, plastic reinforced fibers and paper base materials.

9. A dispenser box adapted for receiving a rolled-sheet of material, said box comprising a container compartment having side, end and bottom walls and a cover for the walls, a blade disposed on the dispenser box so that portions of the sheet material can be dispensed from the box and transversely severed across the blade, the improvement comprising said blade having a severing edge comprising a plurality of spaced-apart members, each member extended from the upper edge of the blade and disposed in the plane of the blade, and each member having a blunt upper edge extremity and at least one side-extended tooth with a piercing tip disposed below the blunt upper edge extremity and in the plane of the blade so that the severing edge of the blade can snag sheet material on the side teeth, thereby causing a segment on the material to be severed.

10. The dispenser box of claim 9 wherein a majority of the spaced-apart members of the blade have at least one tooth extending from each of its sides.

11. The dispenser box of claim 9 wherein the blunt upper edge extremity of the blade extends above the tip of the side extended tooth by at least about 0.003 inch.

12. The dispenser box of claim 9 wherein the blunt upper edge extremity of the blade extends above the tip of the side extended tooth by between about 0.005 inch and about 0.015 inch.

13. The dispenser box of claim 9 wherein the extended members of the blade are uniformly distributed along the edge of the blade.

14. The dispenser box of claim 9 wherein two adjacent extended members of the blade define an arcuate configuration between said members.

15. The dispenser box of claim 14 wherein the arcuate configuration has a beveled edge.

16. The dispenser box of claim 9 wherein the blade is made of a material selected from the group consisting of metals, plastics, plastic reinforced fibers and paper base materials.

17. The dispenser box of claim 9, 10, 11, 12, 13, 14, 15 and 16 wherein the blade forms an integral part of the dispenser.

18. The dispenser box of claim 9, 10, 11, 12, 13, 14, 15 and 16 wherein the blade is a separate component that is secured to the dispenser.

19. The dispenser box of claim 18 wherein the blade is secured to an edge of the box.

20. The dispenser box of claim 18 wherein the blade is secured to a corner of the box.

21. The dispenser box of claim 18 wherein the blade is secured to the cover of the box.

* * * * *